US010210847B1

(12) United States Patent
Leslie

(10) Patent No.: US 10,210,847 B1
(45) Date of Patent: Feb. 19, 2019

(54) LIGHTED VIOLIN BOW

(71) Applicant: Clark W. Leslie, New Harmony, UT (US)

(72) Inventor: Clark W. Leslie, New Harmony, UT (US)

( * ) Notice: Subject to any disclaimer, the term of this patent is extended or adjusted under 35 U.S.C. 154(b) by 0 days.

(21) Appl. No.: 15/913,802

(22) Filed: Mar. 6, 2018

(51) Int. Cl.
*G10D 3/16* (2006.01)
*F21V 33/00* (2006.01)
*F21Y 115/10* (2016.01)

(52) U.S. Cl.
CPC ..... *G10D 3/16* (2013.01); *F21V 33/0056* (2013.01); *F21Y 2115/10* (2016.08)

(58) Field of Classification Search
CPC .... G10D 3/16; F21V 33/0056; F21Y 2115/10
See application file for complete search history.

(56) References Cited

U.S. PATENT DOCUMENTS 2,488,330 A1* 8/2012 Nicklin et al. ..... 84/309

OTHER PUBLICATIONS

Optical Bow Position, Speed, and Contact Point Detection, TROSTER, Sep. 2013.*

* cited by examiner

*Primary Examiner* — Kimberly Lockett
(74) *Attorney, Agent, or Firm* — Gurr Brande & Spendlove, PLLC; Robert A. Gurr

(57) ABSTRACT

A lighted violin bow has a stick, at least one battery coupled to the stick, and a plurality of lights electrically coupled to the battery. The lighted violin bow is placed within a violin case and is configured to illuminate the interior of the violin case.

6 Claims, 4 Drawing Sheets

LIGHTED VIOLIN BOW

CROSS-REFERENCE TO RELATED APPLICATIONS

Not applicable.

TECHNICAL FIELD

The present disclosure relates to violin cases and lighting. More particularly, the present disclosure relates to a lighted violin bow for illuminating the interior of a violin case.

BACKGROUND

Violinists and violists must frequently remove their instruments in low light conditions, such as backstage or in an orchestra pit. This can make it difficult to find rosin, mutes, etc. Some instrument cases have extra brackets for a tube of spare strings that could be used for small under-desk type lights, but care must be taken to prevent their coming loose and damaging the instrument. Most cases lack suitable brackets and would require modifications. As a result, most violinists either prop up a cell phone or hold a penlight in their teeth when necessary. There appear to be no commercially available violin cases that have built-in lights. Accordingly, there is a need to adequately illuminate the interior of a violin or viola case that does not interfere with the instrument, that does not require modifications to current cases, and that is affordable. The present invention seeks to solve these and other problems.

SUMMARY OF EXAMPLE EMBODIMENTS

In one embodiment, a lighted violin bow comprises a stick, at least one battery coupled to the stick, and a plurality of lights electrically coupled to the battery.

In one embodiment, a lighted violin bow comprises a stick, a battery pack coupled to the stick, and a strand of lights configured to mimic violin hair, the lights being electrically coupled to the battery.

In one embodiment, a lighted violin case comprises a violin bow comprising one or more LEDs coupled thereto, the violin bow configured to be received within a violin bow compartment within the case, the LEDs configured to illuminate the interior of the violin case.

DETAILED DESCRIPTION OF EXAMPLE EMBODIMENTS

Figure 1:
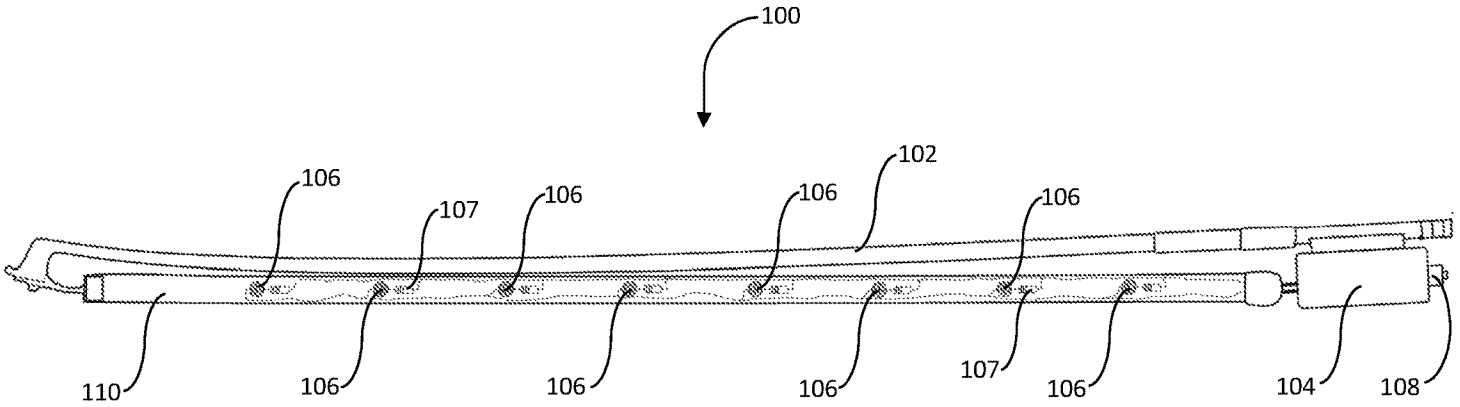
FIG. 1 illustrates a side elevation view of a lighted violin bow.
Figure 2:
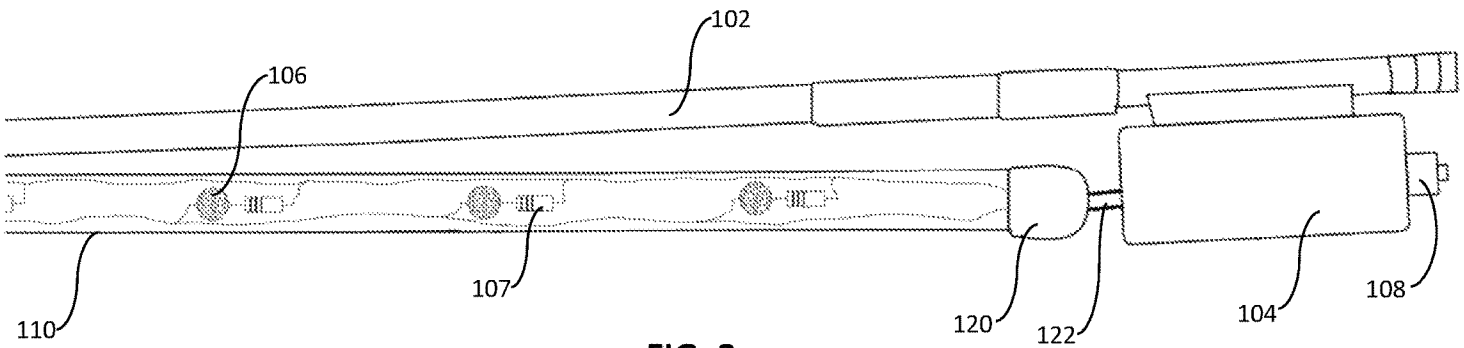
FIG. 2 illustrates a detailed, side elevation view of a lighted violin bow.
Figure 3:
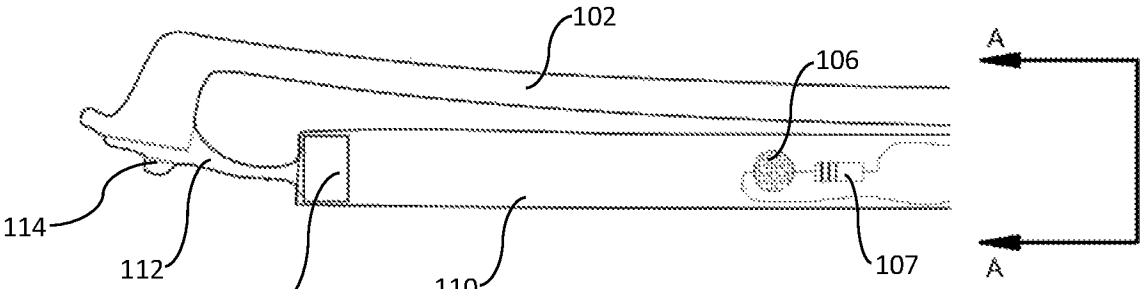
FIG. 3 illustrates a detailed, side elevation view of a lighted violin bow.
Figure 5:
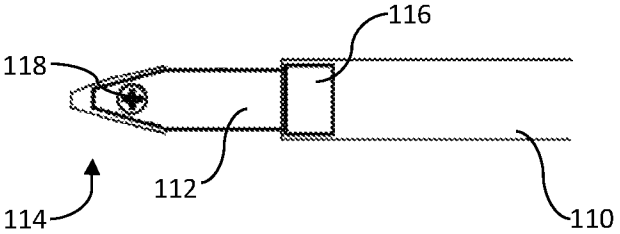
FIG. 5 illustrates a detailed bottom view of an end of a lighted violin bow.
Figure 4:
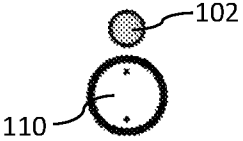
FIG. 4 illustrates a cross-section along lines A-A of FIG. 3.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need to adequately illuminate the interior of a violin or viola case that does not interfere with the instrument, that does not require modifications to current cases, and that is affordable. As will be appreciated from this disclosure, the lighted violin bow disclosed herein solves these and other problems. While the examples herein generally refer to violin bows and cases, it will be appreciated that these examples are non-limiting, and that other instruments and cases may be used, such as the viola or cello.

Almost all violin and viola cases have at least two (four is common) holders in the case lid for the bow. These usually have a fixed compartment or bracket for the bow tip and either a spring clip to hold the stick and frog (i.e., rectangular device on the end of the bow stick proximal to the user), or a rotating bar that fits between the stick and the bow hair and turns to latch the bow in place.

The solution, therefore, is a device the size and shape of a bow, but with the bow hair replaced by a plurality of light-emitting diodes (LEDs) and load resistors, and the frog being replaced by a battery compartment and switch assembly. This then fits in an existing bracket of either type which has been used safely for many years and which would give confidence that the device could not come loose and damage an expensive instrument. While LEDs are not required, they are beneficial for several reasons, including low power consumption and waste heat. Accordingly, the use of low power LEDs eliminates the possibility of excess heat if the lights are accidentally left on, which prevents damage to the instrument. In one embodiment, the LEDs may be within a tube, which may be rotated to provide optimum aiming of the lights. The resemblance of the device to an actual bow provides an unobtrusive means to provide light for the musician. As used herein, a "lighted bow for a musical instrument" may refer to a violin bow, viola bow, cello bow, or similar musical bow.

Accordingly, in one embodiment, as shown in FIG. 1, a lighted bow for a musical instrument 100 comprises a stick 102, at least one battery (e.g., within battery compartment 104) coupled to the stick 102, and a plurality of LEDs 106 electrically coupled to the battery within compartment 104. It will be appreciated that while the battery is described as being located within a compartment 104, such compartment is not necessary, and the battery may be coupled to the stick in any number of manners, such as brackets, straps, or other means. In a preferred embodiment, the battery compartment further comprises a switch 108 for manual activation by a user. However, other methods of turning ON/OFF the LEDs 106 are contemplated, such as the use of motion sensors, magnetics, or other means, which may likewise be configured within, or coupled to, the battery compartment 108. Further, while the LEDs 106 are illustrated as being separate from the stick 102, it will be appreciated that such configuration is not required. In other words, the LEDs 106 may be directly attached or coupled to the stick 102. As shown in the Figures, the strand of LEDs 106 are located within a tube 110. The tube 110 is coupled to the stick 102 on a first end using a bracket 112, the bracket 112 comprising a first end 114 for coupling to the stick 102 and a second end 116 for coupling to the tube 110. A screw 118, or other fastener, may be used to secure the first end 114 to the stick 102. An end cap 120 is positioned at the opposite end of the stick 102 and is coupled to the battery compartment via wire channel 122. The end cap 120 may be configured to rotate on the wire channel 122 so that the tube 110 may freely rotate. The tube 110 with LEDs 106 replace the hair of a standard bow. This allows the lighted bow 100 to not only produce light, but it also maintains an elegant look when not in use.

Figure 7:
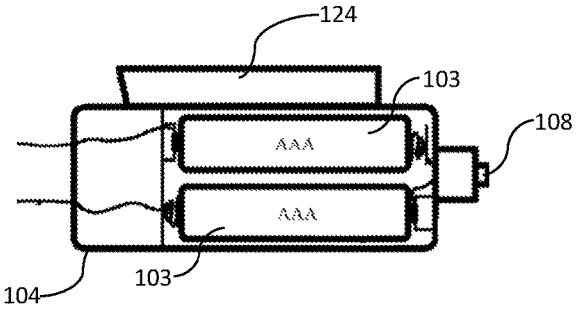
FIG. 7 illustrates a cross-section of a battery compartment of a lighted violin bow.
Figure 6:
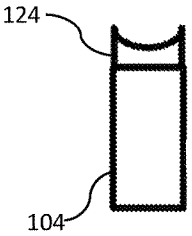
FIG. 6 illustrates a front elevation view of a battery compartment of a lighted violin bow.

FIGS. 6 and 7 illustrate the battery compartment 104 in greater detail. Mounting bracket 124 is attached to the top of the compartment 104, and, as shown in FIG. 6, is configured to complement the stick 102. Fasteners may be used to secure the compartment 102 to the stick, including hooks and loops, tongue and groove configurations, or by simply using a screw through the stick 102 to engage the mounting bracket 124. The compartment 104 may be similar in size and shape to a frog, and may likewise be similarly attached as a standard frog to a violin stick. While not shown, another method of storing one or more batteries 103 would be a cavity in the end of the stick 102, wherein the batteries 103 are inserted therein. In such a scenario, the diameter of the stick may be larger, as needed, to accommodate larger batteries. In one example, two AAA batteries (1.5V) are used to power the LEDs. While LEDs are used as examples throughout, other lighting devices may be used without departing herefrom.

Figure 8:
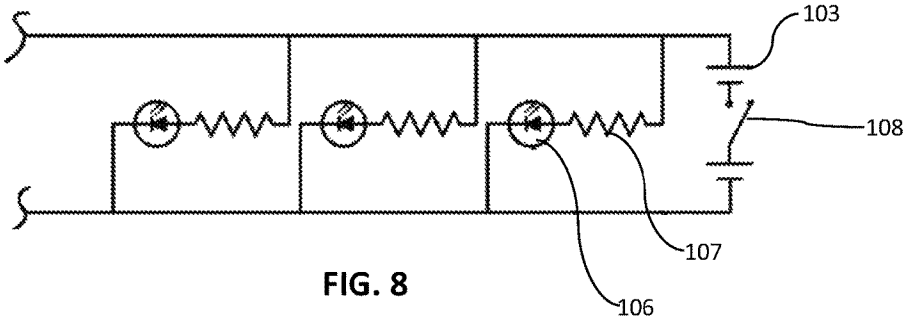
FIG. 8 illustrates an electrical schematic of a lighted violin bow.

FIG. 8 illustrates a non-limiting, standard example of an electrical schematic. It illustrates a SPST switch 108, a 200 Ohm ¼ Watt resistor 107, and three LEDs 106. Accordingly, when a user actuates the switch 108, the circuit is closed and the LEDs illuminate.

Figure 9:
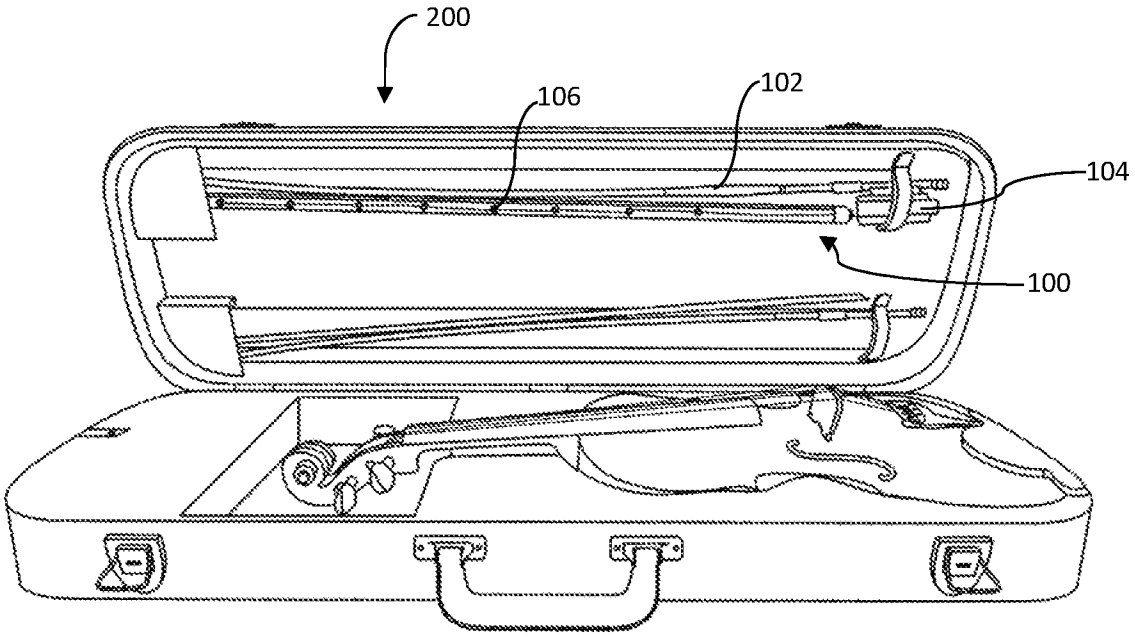
FIG. 9 illustrates a lighted violin bow stored in a case.

As shown in FIG. 9, in one embodiment, a lighted violin case 200 comprises a lighted bow 100 comprising one or more LEDs 106 coupled thereto, the lighted bow 100 configured to be received within a violin bow compartment within the case 200, the LEDs 106 configured to illuminate the interior of the violin case 200.

Accordingly, in one method of use, a user would place a lighted bow 100 into a storage compartment of a musical instrument case 200 (e.g., violin, viola, cello, etc.). In low light conditions, after a user has opened the case 200, a user may actuate the switch 108, which illuminates the LEDs 106 and thereby illuminates the interior of the case 200. The user may then have easy access to the instrument in low light conditions without fear of damaging their musical instrument. As appreciated, a user does not need to modify the current case or buy a new case to take advantage of the lighted-bow disclosed herein. Therefore, the lighted-bow described herein solves the need to adequately illuminate the interior of a violin or viola case that does not interfere with the instrument, that does not require modifications to current cases, and that is affordable.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A lighted bow for illuminating a case of a musical instrument, the lighted bow comprising:

a stick;

a strand of lights in place of hair of the bow;

at least one battery coupled to the stick; and the strand of lights electrically coupled to the battery;

wherein the lighted bow illuminates the case of the musical instrument.

2. The lighted bow for illuminating a case of a musical instrument of claim 1, further comprising a tube coupled to the stick, wherein the strand of lights pass through the tube.

3. The lighted bow for illuminating a case of a musical instrument of claim 1, wherein the lights are light-emitting diodes.

4. The lighted bow for illuminating a case of a musical instrument of claim 1, further comprising a battery compartment in similar configuration to a frog.

5. A lighted bow for illuminating a case of a musical instrument, the lighted bow comprising:

a stick;

a battery compartment coupled to a first end of the stick, the battery compartment housing at least one battery and further comprising a switch;

a first end of a tube coupled to the battery compartment and a second end of the tube coupled to a second end of the stick, the tube replacing hair of the bow;

a plurality of LEDs passing through the tube and being electrically coupled to the one or more batteries, the LEDs being electrically controlled via the switch.

6. A method of using a lighted bow for illuminating a case of a musical instrument of claim 5, comprising:

securing the lighted bow to the interior of a musical instrument case; and selectively illuminating the LEDs of the lighted bow via the switch.

* * * * *